US007537102B2

(12) United States Patent
Matheisl et al.

(10) Patent No.: US 7,537,102 B2
(45) Date of Patent: May 26, 2009

(54) TRANSPORTATION DEVICE WITH SIMPLIFIED TREAD UNITS

(75) Inventors: Michael Matheisl, Vosendorf (AT); Thomas Novacek, Schwechat (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/960,011

(22) Filed: Dec. 19, 2007

(65) Prior Publication Data

US 2008/0149457 A1 Jun. 26, 2008

(30) Foreign Application Priority Data

Dec. 21, 2006 (EP) ..... 06126811

(51) Int. Cl.
*B66B 21/12* (2006.01)

(52) U.S. Cl. ..... 198/334; 198/326; 198/332

(58) Field of Classification Search ..... 198/321, 198/325, 326, 327, 328, 331, 332, 333
See application file for complete search history.

(56) References Cited

U.S. PATENT DOCUMENTS 1,793,498 A * 2/1931 Heritier ..... 198/334
4,681,206 A * 7/1987 Sugita ..... 198/328
4,884,673 A * 12/1989 Rivera ..... 198/328
4,927,006 A 5/1990 Dolan
5,033,606 A * 7/1991 Matoba et al. ..... 198/328
6,341,683 B1 * 1/2002 Hattori et al. ..... 198/334

FOREIGN PATENT DOCUMENTS

DE 25 16 151 A1 10/1976
DE 200 18 893 U1 5/2001
GB 2 173 757 A 10/1986

* cited by examiner

*Primary Examiner*—James R Bidwell
(74) *Attorney, Agent, or Firm*—Ladas & Parry LLP

(57) ABSTRACT

A transportation device with steps or pallets arranged in the form of an endless transporter. The transportation device has two or more advance guide rails which are arranged in an advance area of the transportation device, and two return guide rails which are arranged in a return area of the transportation device. Each step or pallet has sliding elements fastened to it have an advance sliding surface and a return sliding surface. In the advance area each step or pallet is oriented with the advance sliding surfaces of the two respective sliding elements on the advance guide rails and slides along the advance guide rails.

10 Claims, 5 Drawing Sheets

Detail Y

Schnitt Z–Z

SECTION

TRANSPORTATION DEVICE WITH SIMPLIFIED TREAD UNITS

The present invention relates to a transportation device such as an escalator or moving walk and in particular to tread units, such as escalator steps or moving-walk pallets, used in such a transportation device.

BACKGROUND OF THE INVENTION

Transportation devices in the sense of the invention, which may also be referred to as transportation devices, are escalators and moving walks with a plurality of tread units, or steps or moving-walk pallets, that are joined to form an endless transporter or chain. The users of the transportation devices stand on tread surfaces of the tread units, or walk on the moving-walk pallets, in the same direction of movement as the transportation devices themselves.

In escalators, the escalator steps form the tread units, hereinafter referred to as steps, and in moving walks the moving-walk pallets form tread units, hereinafter referred to as pallets. Escalators have a relatively large angle of inclination to overcome relatively large height differences, often between complete building stories or greater. In contrast, moving walks run horizontally, or at a slight inclination, but generally with a smaller angle of inclination than escalators.

Typically, such transportation devices contain step bands, pallet bands, generally transportation bands, which are typically embodied as step chains or pallet chains. Hereinafter, in the interest of simplicity, reference is made only to transportation bands or chains. These transportation bands are driven to move the steps or pallets in the direction of transportation, transport them continuously and endlessly and, according to the prior art, are provided with rollers at equal intervals. The rollers roll along defined, dedicated tracks. In the area of the ends of the transportation devices, the transportation bands with the rollers pass around reversing wheels (e.g. sprockets) or reversers, and thereby undergo a change of direction.

An exemplary transportation device is known from patent EP 1 236 672 B1. The objective of that patent is primarily to keep the gap between a balustrade and a step or pallet as small as possible to reduce the risk of injury. In that patent, there is passing or superficial mention of sliding elements or rolling elements. The sliding or rolling elements are fastened directly onto a step chain which, as described above, serves as a transportation band. The step chain with the sliding or rolling elements thereby serves to drive the steps. Shown throughout the drawings of that patent are rolling elements that are rotationally symmetrical about an axis of rotation and which roll about their axis of rotation along the guide rails or tracks.

It is regarded as a disadvantage of transportation devices hitherto that, in addition to the step chains including rollers on each step, two further transportation or step rollers are required that roll along separate tracks. Such a solution is costly, since the rollers on the steps are expensive, as well as work- and cost-intensive. This is particularly because corresponding ball bearings or roller bearings are required to enable the rollers to be fastened to the steps. On the other hand, however, the rollers that are fastened to the steps or pallets are important components of the transportation device, since they have a direct influence on ride comfort. Furthermore, these rollers make a not insignificant contribution to a quiet, even, and jerk-free running of the transportation device.

There has thus arisen a desire to replace the individual roller components by less expensive, or simpler, parts, but without thereby impairing ride comfort or travel characteristics.

BRIEF DESCRIPTION OF THE INVENTION

In accordance with the foregoing, the object of the present invention is to present a transportation device of the type stated at the outset but which nonetheless allows quiet, jerk-free running, is not susceptible to faults, and has a long service life. According to the invention, this objective is fulfilled in a transportation device in which the steps or pallets, have sliding elements with advance and return sliding surfaces. The advance surface sliding along a return sliding element may slide along a return sliding surface when the step or pallet is in a return area.

BRIEF DESCRIPTION OF THE DRAWINGS

Illustrative embodiments of the invention are described in detail below and by reference to the drawings, in which.

DETAILED DESCRIPTION OF THE INVENTION

Figure 1:
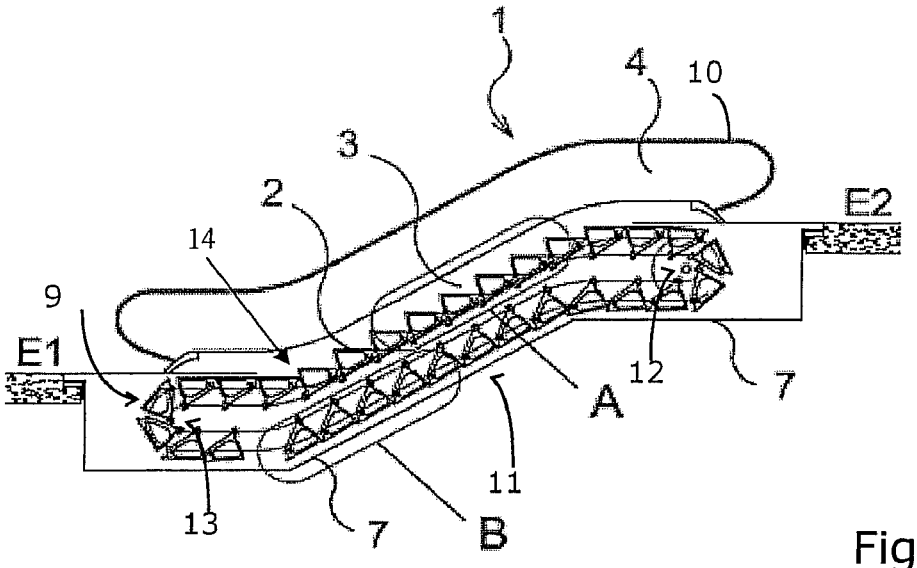
FIG. 1 is a diagrammatic side view, partially cut away, of a transportation device of the invention in the form of an escalator.

The transportation device 1 shown in FIG. 1 is an escalator that connects a lower level El with an upper level E2. The transportation device 1 has side balustrades 4, and as visible moving parts, steps 2 of an endless transporter. Typically used as transportation bands are two step chains or transportation chains that run parallel to each other with rollers to impart motion to the steps 2. However, according to the parallel application mentioned at the outset, step chains with rollers and/or sliding elements can also be used.

An endless handrail 10 is also provided. The handrail 10 moves as one or simultaneously with the transportation bands and the steps 2. Indicated by reference number 7 is the support, or truss, and by reference number 3 the side skirt panel, of the transportation device 1.

The endless transporter of the transportation device 1 essentially comprises a plurality of tread units (steps 2) and the two transportation bands, step chains, or transportation chains, that are arranged at the sides, between which the steps 2 are arranged and to which the steps 2 are mechanically connected. Furthermore, the endless transporter contains, for example, a drive (not shown) as well as an upper reverser 12 and a lower reverser 13 that are respectively situated in the upper and lower end areas of the transportation device 1. The steps 2 have tread surfaces or standing surfaces 9.

As indicated in FIG. 1, from the lower reverser 13, which is situated in the area of the lower level E1, the steps run diagonally upward to the upper reverser 12, which is situated in the area of the upper level E2. This area, which leads from the lower reverser 13 to the upper reverser 12, is hereinafter also referred to as the transportation area 14 of the transportation device 1, since in this area, the tread surfaces 9 of the steps 2 face up, and can therefore accommodate and transport persons. Return of the steps 2 from the upper reverser 12 to the lower reverser 13 takes place in a return area 11. This return area 11 is situated below the advance or transportation area 14. During the return in the return area 11, the tread surfaces 9 of the steps 2 face down.

Figure 2A:
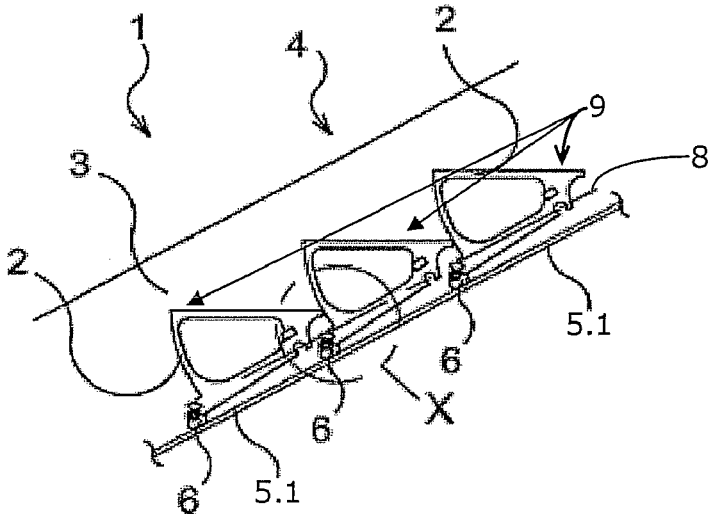
FIG. 2A is an enlarged detail view of area A in FIG. 1 of the transportation device.
Figure 2B:
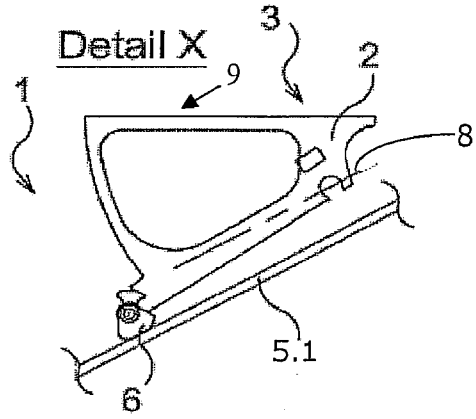
FIG. 2B is a further enlarged in detail of area X in FIG. 2A.

According to a first embodiment of the invention that is shown in greater detail in FIGS. 2A to 4C, use is now made for the first time of steps 2 which, instead of the rollers that are usually fastened directly to the steps 2, have so-called sliding elements 6. Hereinafter the sliding elements 6 are referred to as step skids. According to the invention, the step skids 6 are mechanically linked to the respective steps 2, and executed in such a manner that, in the advance area 14, they slide along a first guide rail 5.1 when the endless transporter of the transportation device 1 is in motion, as will be explained in greater detail by reference to FIGS. 2A and 2B. In the present context, to make their function clear, the first guide rails 5.1 may also be referred to as advance rails or advance guide rails. In FIGS. 2A and 2B, the path, or position, of the step chain with the rollers situated on it is indicated by the line 8.

Figure 3A:
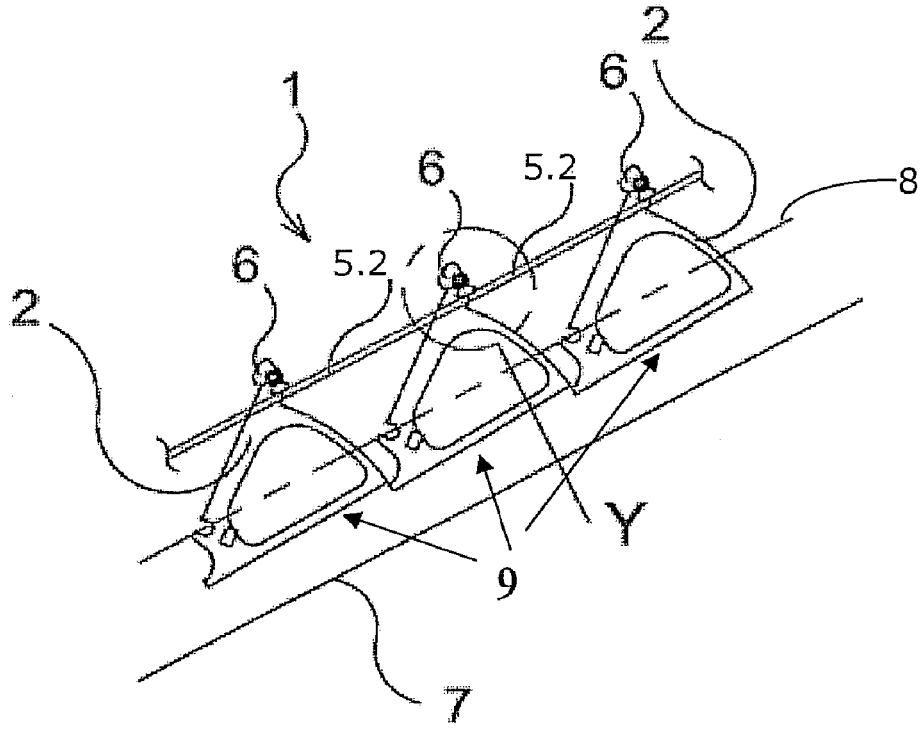
FIG. 3A is an enlarged detail view of area B in FIG. 1.
Figure 3B:
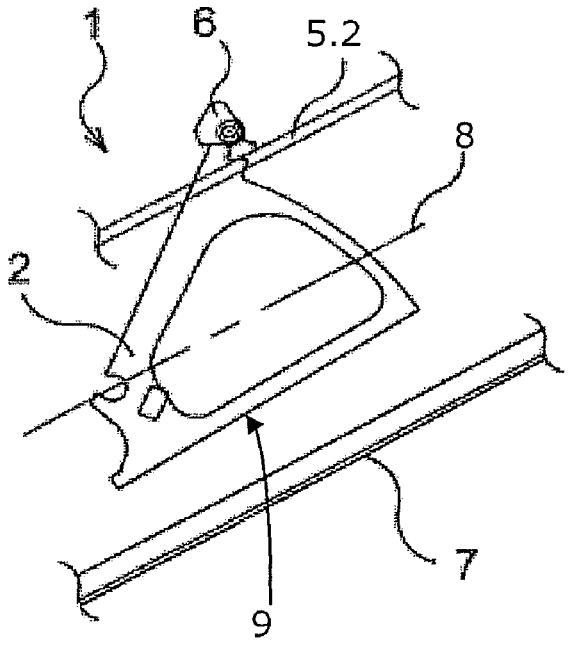
FIG. 3B is a further enlarged detail view of area Y in FIG. 3A.

In the return area 11, the sliding elements 6 slide along a second or return guide rail 5.2, as will be explained in greater detail by reference to FIGS. 3A and 3B. Here also the return path or position of the step chain, with the rollers that are situated on it, is indicated in the figures by the line 8.

Figure 4A:
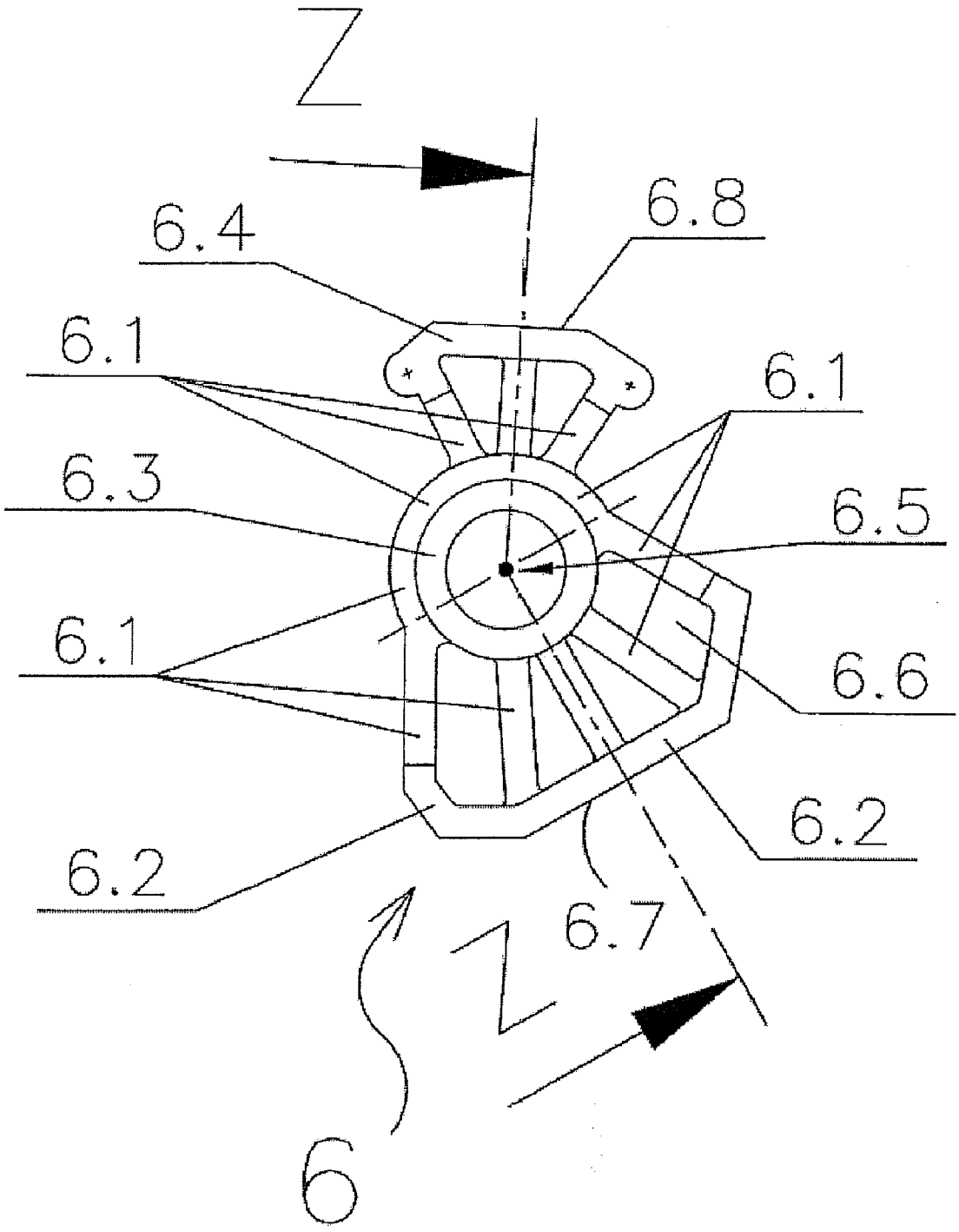
FIG. 4A is an enlarged side view of a sliding element.

So that the sliding elements 6 are suitable as equal replacements for rollers, step rollers, rollers with ball bearings, or roller bearings, as used hitherto, each sliding element 6 has a so-called advance sliding surface or segment 6.2 for sliding along the advance guide rail 5.1. A separate, i.e. spatially separated, second return sliding surface or section 6.4 is provided for sliding along the return guide rail 5.2, which will be explained in greater detail by reference to FIGS. 4A and 4B. Shown in FIG. 4A is a plan or front view of a sliding element 6. To make a better description of the position or orientation of the individual elements possible, hereinafter reference is made to the position of the hour hand of a clock, assumed to turn about the central axis 6.5 of the sliding element 6. The advance sliding surface 6.2 of the sliding element 6 has a sliding surface 6.7 that runs tangential to the five o'clock position of the hour hand. The end, or runout, surfaces of this sliding surface are slightly beveled, domed, or rounded. This results in a skid-like embodiment of the advance sliding surface 6.2, which allows a problem-free run-in and run-out of the sliding element 6 on the advance guide rail 5.1. In addition, the skid-like embodiment prevents wedging or jamming of the sliding element on the advance guide rail.

Situated approximately at the twelve o'clock position of the hour hand is the return sliding surface 6.4. The sliding surface 6.8 of the return sliding surface 6.4 runs essentially tangential to an hour hand that is situated in the twelve o'clock position. The end, or runout, zones of this sliding surface are again slightly beveled, domed, or rounded. This results in a skid-like embodiment of the return sliding surface 6.4, which similarly allows a problem-free run-in and run-out of the sliding element 6 in or on, the return guiderail 5.2. In addition, the skid-like embodiment prevents wedging or catching of the sliding element on the return guide rail 5.2.

It should be noted here that the angle W between the advance sliding surface 6.2 and the return sliding surface 6.4 depends on the constellation of the transportation device 1. In a moving walk that runs horizontally, the tangential surfaces of the advance sliding surfaces 6.2, and of the return sliding surfaces 6.4, lie preferably exactly opposite each other (the two tangential surfaces are parallel in opposite directions, i.e. the angle W between the two is approximately 180 degrees). Shown in FIG. 4A is a variant for use in an escalator that overcomes a difference in height between two stories E1 and E2. The tangential surfaces 6.7 and 6.8 of the sliding surfaces 6.2 and 6.4 are slightly inclined relative to each other. In other words, the angle W is less than 180 degrees. In the example that is shown, the angle W is approximately 145 degrees, as indicated diagrammatically in FIG. 4C, where the perpendiculars to the sliding surfaces 6.8 and 6.7 running through the central axis 6.5 are shown. Preferably, the angle W lies between 180 and 120 degrees.

To take account of the fact that, when the sliding elements 6 slide along the advance guiderail 5.1, greater forces occur than when they slide along the return sliding surface 6.4, the advance sliding surfaces 6.2 are preferably executed larger or more stable than the return sliding surfaces 6.4, as can be seen in FIG. 4A. The greater forces result from the fact that, on stepping onto a step 2, the weight forces must be transmitted via the advance sliding surfaces 6.2 of the sliding elements 6 into the advance guide rails 5.1. When the steps 2 return, they slide, along with the sliding elements 6, on the return guide rails 5.2. In this case, the sliding elements 6 and the return sliding surfaces 6.4 need mainly only bear the weight of the step 2, which is made of lightweight metal.

To allow fastening of a sliding element 6 onto the side of a step 2, the sliding element 6 has an inset, socket or sliding bearing, bushing 6.3, which is arranged coaxially with the central axis 6.5 of the sliding element 6. It is preferable that the sliding element 6 be designed in such manner that it can be fastened to the steps 2 in the same manner as the rollers and step rollers that have been hitherto used. This can be achieved by, for example, corresponding dimensioning of the inset, socket, or sliding bearing bushing, such that the sliding element can be simply placed on the axle that was originally provided for a roller. This makes it possible to replace the rollers of existing transportation devices 1 by sliding elements 6.

Figure 4B:
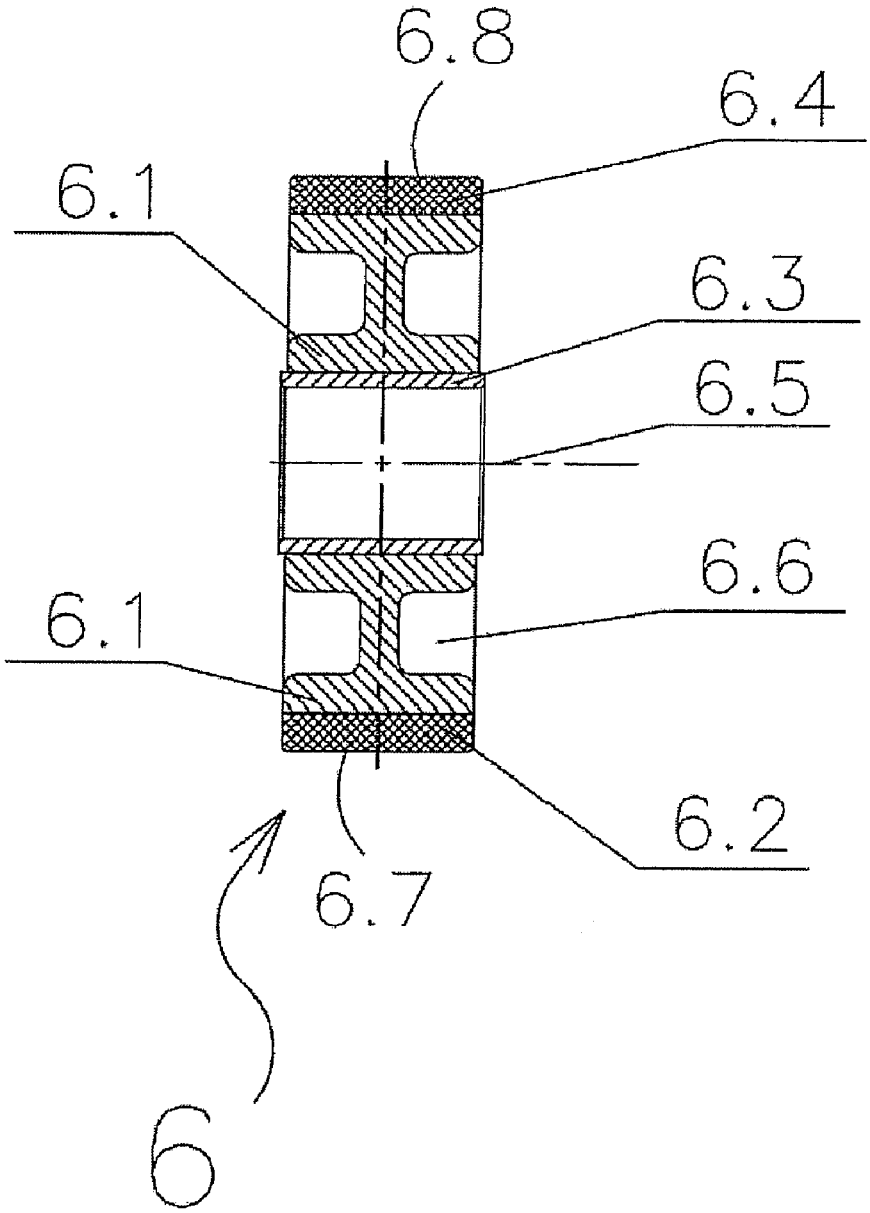
FIG. 4B is a cross-section view of the sliding element of FIG. 4A along the line Z-Z of FIG. 4A.
Figure 4C:
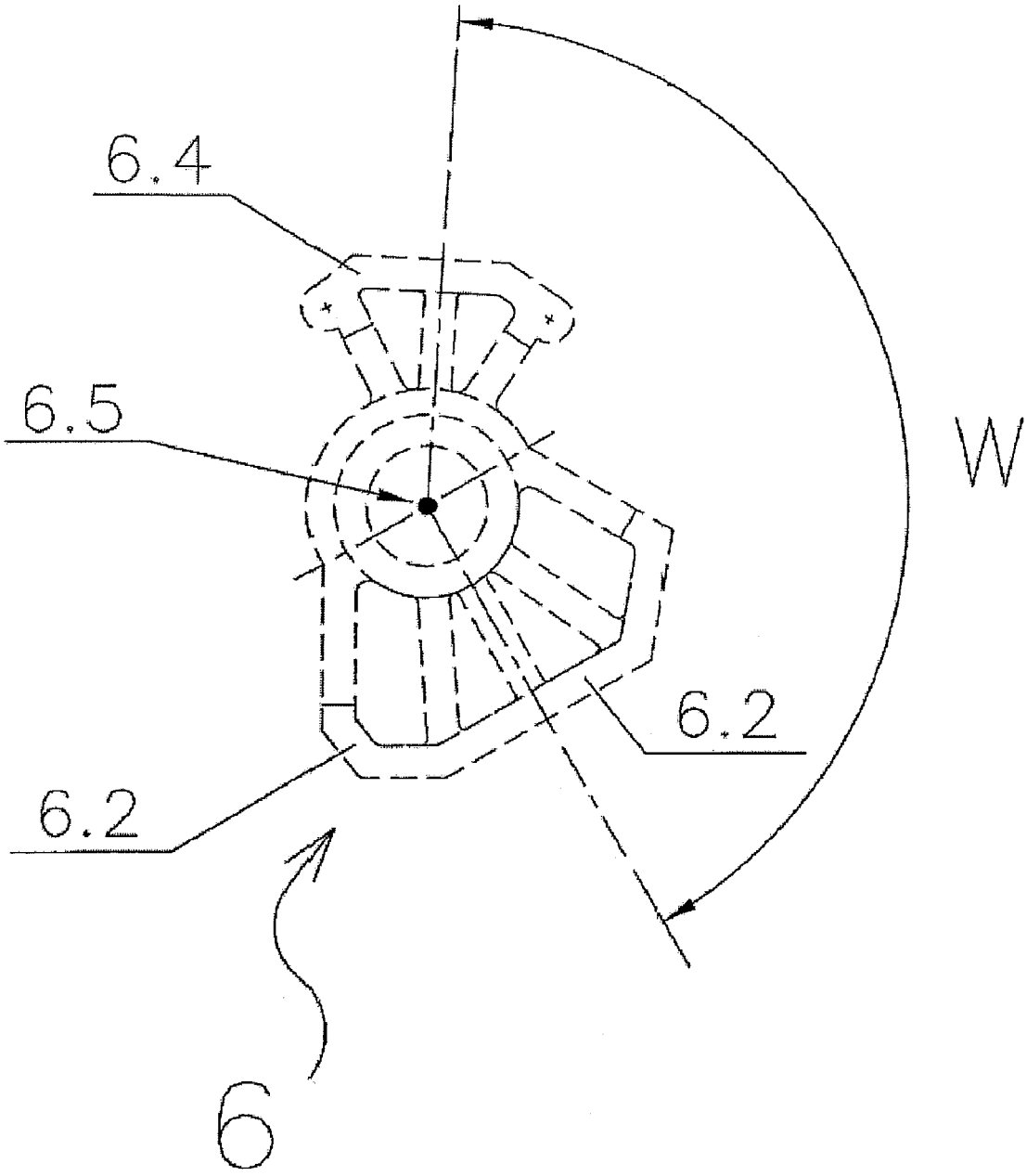
FIG. 4C presents a diagrammatic explanation of the geometrical determination of the angle W.

The sliding element 6 can have a base body or supporting element 6.1, that connects and/or supports the individual elements 6.2, 6.3, 6.4. Shown in FIGS. 4A and 4B is an embodiment in which the supporting element 6.1, along with the other elements 6.2 and 6.4, is made from plastic, for example an injection-molded plastic, or from a milled or cast part or parts. Preferably, a single piece sliding element 6 is used, that is made throughout of one and the same material. If necessary, however, the advance sliding surface 6.2, and/or the return sliding surface 6.4, can be of a different material, or be coated with a different material, as will be described further below. To make the sliding element 6 as inexpensive and light as possible, recesses, openings, or breakouts 6.6 can be provided.

In FIG. 4B, which shows a cross-section along the angled line Z-Z in FIG. 4A, it can be seen that the base body 6.1 has thin webs or the like which, when viewed from the central axis 6.5, extend at least partly like the spokes of a wheel in the radial direction and support, bear, or frame the advance sliding surface 6.2 and the return sliding surface 6.4.

It is preferable that the advance sliding surface 6.2 and/or the return sliding surface 6.4, be coated with a material or sliding material, or to contain a material that has a low coefficient of friction. Especially suitable is a sliding surface 6.2 or 6.4 with a polytetrafluorethylene (PTFE) polyurethane bandage. An aramid coating or aramid fibers, can also be used, along with other appropriate thermoplastic or elastomeric materials, including other fluoropolymers, polymides, and butyl rubber. These bandage zones are preferably hydrolyte-resistant or hydrolyte-stabilized.

PTFE is particularly suitable on account of its suitable material combinations, low coefficient of friction, and its robustness. Since PTFE slides particularly well on PTFE, in a preferred embodiment, guide rails 5.1 and/or 5.2 are used that are also provided with PTFE or PTFE-like modified plastics. Furthermore, with suitable material combinations, the static friction of PTFE is exactly the same as its sliding friction, so that the transition from standstill to movement takes place without jerking, which for applications in the area of the transportation device(s) is particularly advantageous.

Since, as previously described, main forces arise between advance guide rails 5.1 and the advance sliding surfaces 6.2, in a preferred embodiment at least the advance sliding surfaces 6.2 and/or advance guide rails 5.1 are coated with or contain such a suitable material.

In another currently preferred embodiment of the invention, the sliding elements 6 are executed, and fastened to the steps 2, in such a manner that they allow a slight swiveling or rotational movement about the central axis 6.5. By this means, even smoother running can be obtained. In another variant, the sliding elements 6 can be simply pushed onto the sides of the steps 2 and engaged.

The present invention allows a completely new generation of moving walks and escalators to be realized that completely, or at least partly, dispenses with rollers. Such a transportation device is less expensive more cost-beneficial by using the sliding element in place of rollers. This has the advantage of eliminating the needed expensive and work-intensive ball bearings that are contained in the rollers of the steps 2. The invention as described is equally or equivalently applicable to both escalators and moving walks.

We claim:

1. A transportation device with a plurality of steps or pallets, advance guide rails are arranged in an advance area of the transportation device and return guide rails arranged in a return area of the transportation device, characterized in that each step or pallet has fastened thereto pallet sliding elements having an advance sliding surface and a return sliding surface, the steps or pallets being movable in a direction of transportation when the transportation device is in operation, the sliding elements being dimensioned and located to support the steps or pallets upon the advance guide rails in the advance area with the advance sliding surfaces in sliding contact with the advance guide rails.

2. A transportation device according to claim 1, characterized in that the sliding elements are further dimensioned and located to support the steps or pallets upon the return rails in the return area with the return sliding surface in sliding contact with the return guide rails.

3. A transportation device according to claim 1 or 2, characterized in that, in the advance area each of the steps or pallets is supported at two points on the advance guide rails by means of two sliding elements.

4. A transportation device according to claim 1 or 2, characterized in that per each step or pallet, two sliding elements are provided for support of each step or pallet, each sliding element having an advance sliding surface and a separate return sliding surface.

5. A transportation device according to claim 1 or 2, characterized in that the advance sliding surface and the reverse sliding surface are each in the form of a skid.

6. A transportation device according to claim 1 or 2, characterized in that at least one of the advance sliding surface, the return sliding surface, the advance guide rail or the return guide rail are constructed such that a low coefficient of friction between a sliding surface and a guide rail exists.

7. A transportation device according to claim 6, characterized in that at least one of the advance sliding surface, the return sliding surface, the advance guide rail or the return guide rail includes polytetrafluorethylene.

8. A transportation device according to claim 1 or 2, characterized in that each of the sliding elements has an inset bushing to directly mechanically connect the sliding element to the step or pallet.

9. A transportation device according to claim 4, characterized in that at least one of the advance sliding surface, the return sliding surface, the advance guide rail or the return guide rail includes a thermoplastic or elastomeric material, polytetrafluorethylene, polyurethane, polyamide, aramid, or butyl rubber such that a low coefficient of friction between a sliding surface and a guide rail exists.

10. A transportation device according to claim 1 or 2, characterized in that the transportation device further comprises two essentially parallel running transportation bands, the steps or pallets being arranged in succession between the transportation bands and mechanically connected thereto.

* * * * *